United States Patent [19]

Limberger et al.

[11] Patent Number: 4,867,589

[45] Date of Patent: Sep. 19, 1989

[54] MATRIX PRINTER WITH INK RIBBON GUIDE DISPOSED ON PRINT HEAD CARRIAGE

[75] Inventors: Alois Limberger, Grüningen; Bernhard Nolte, Villingen; Dieter Stellmach, Bad Dürrheim; Hans J. Wysk, Villingen, all of Fed. Rep. of Germany

[73] Assignee: Mannesmann Aktiengesellschaft, Düsseldorf, Fed. Rep. of Germany

[21] Appl. No.: 161,910

[22] Filed: Feb. 29, 1988

[30] Foreign Application Priority Data

Feb. 28, 1987 [DE] Fed. Rep. of Germany ..... 3706560

[51] Int. Cl.[4] ..... B41J 35/04

[52] U.S. Cl. ..... 400/248; 400/175

[58] Field of Search ..... 400/175, 248, 248.1, 400/250

[56] References Cited

U.S. PATENT DOCUMENTS

| | | | |
|---|---|---|---|
| 4,444,519 | 4/1984 | Howell | 400/82 |
| 4,473,312 | 9/1984 | Forschner | 400/175 |

FOREIGN PATENT DOCUMENTS

| | | | |
|---|---|---|---|
| 2450594 | 4/1975 | Fed. Rep. of Germany | 400/120 |
| 104782 | 6/1983 | Japan | 400/248 |
| 194882 | 11/1984 | Japan | 400/248 |
| 224380 | 12/1984 | Japan | 400/175 |
| 40283 | 3/1985 | Japan | 400/175 |

*Primary Examiner*—Paul T. Sewell

*Attorney, Agent, or Firm*—Horst M. Kasper

[57] ABSTRACT

A printer, and in particular a matrix printer, is provided with a carriage guide running parallel in front of a print-surface support for a print-head carriage (3). The print-head carriage (3) supports a print head (4) and an ink-ribbon guide (8), disposed on the print-head carriage (3). The print head (4) can be exchanged even by the operating personnel of the matrix printer by using a print head (4) which is exchangeable in a mechanical guide (6) and which is connected with an electric plug connection (7) and is thus removable and again insertable into the print-head carriage (3). At least one tiltable ink-ribbon guide (8) is disposed on the print-head carriage (3) and serves as a locking means (9) for the inserted print head (4) on the print-head carriage (3).

21 Claims, 4 Drawing Sheets

MATRIX PRINTER WITH INK RIBBON GUIDE DISPOSED ON PRINT HEAD CARRIAGE

BACKGROUND OF THE INVENTION

1. Field of the Invention

The invention relates to a printer, and in particular to a matrix printer with a carriage guide running in parallel in front of a print-surface support for a print-head carriage, which supports a print head and where an ink-ribbon guide is disposed on the print-head carriage.

2. Brief Description of the Background of the Invention Including Prior Art

Such printers are operated by personnel which are in general not very skilled in technical matters and which have to exchange from time to time, in addition to the necessary replenishment of print-support materials, also worn and defective ink ribbons. Special printers, which are set during the operation to specific requirements, such as for example multiple-form printing or, respectively, savings-booklet printing, and the like, require today, in addition to the exchange of the ink-ribbon cassette, also an exchange of the print head. Such an exchange of the print head can become necessary based on various circumstances. On the one hand, defective print heads are to be exchanged against operable print heads and, on the other hand, other print heads should be exchanged amongst each other where they have different properties. For example, print heads can be equipped for standard-type printing and special print heads might be needed such as, for example, print heads which are suitable for optical character recording, OCR, writing. Therefore, if the operating personnel is required to exchange the print head for whatever reason, certain defined preconditions have to be adhered to. It is not possible to require the operating personnel to handle special tools and to perform certain extensive demounting operations, where loose parts are necessary for the attachment of the ink ribbon or, respectively, of the print head. It is not advantageous to use attachment parts, such as screws and nuts, since there exists the danger that these parts can be lost or can even fall into the interior of the printer and cause damage there. A further difficulty exists in that, during the exchange of the print head, the electric connection lines to the individual print elements on the print side have to be disengaged and they have to be reconnected after the insertion of another print head.

A carrier with a pin-print head is known from German Petit Patent DE-GM No. 7,800,250, where the print head is disengageably disposed on a special carrier and where the attachment is performed via a nose on the pin-guide casing, against which a bow is tensioned. This reference describes only the support and the attachment of the print head.

A different attachment for an exchangeable pin-print head is given in the German Petit Patent DE-GM No. 7,405,484 and requires a recess in the print-head carriage, where the recess has a partly circular and partly rectangular cross-section, into which recess the print head is inserted. In a certain way, the support is provided here by a bearing block. However, no solution is given in this reference relating to the electric connection part of the print head. Furthermore, the solutions taught do not provide any suggestions relating to the guiding of the ink ribbon.

SUMMARY OF THE INVENTION

Purposes of the Invention

It is an object of the invention to provide a printer, and in particular a matrix printer, where the operating personnel is capable not only to change the ink-ribbon cassette, but also to perform exchanges of the print head without difficulties.

It is a further object of the present invention to provide a matrix printer which is easily serviceable and which allows an easy insertion of the ink ribbon onto a guide disposed on the print-head carriage.

It is a further object of the invention to provide a matrix printer where the print-head carriage allows easy manipulation of parts subject to wear.

These and other objects and advantages of the present invention will become evident from the description which follows.

BRIEF DESCRIPTION OF THE INVENTION

According to the invention, a matrix printer comprises a print surface support. A carriage guide is disposed in parallel in front of the print-surface support. The matrix printer furthermore comprises a print head, a mechanical guide, an electric plug connection, and an ink-ribbon guide. A print-head carriage is guided by the carriage guide and supports the print head. The ink-ribbon guide is disposed on the print-head carriage. The print head can be insertingly positioned and released on the print-head carriage via the mechanical guide and with an electric plug connection disposed at the print head carriage. At least one ink-ribbon guide is rotatably disposed on the print-head carriage as locking means for the insertingly positioned print head on the print-head carriage.

The mechanical guide can comprise two parallel alignment pins in perpendicular position attached to the print-head carriage. Bores corresponding to the alignment pins can be coordinated in a flange of the print head. The electric plug connection can comprise a plug contact strip. The electric plug connection can be furnished by an insertion of the print head, where the print head is already guided section-wise on the alignment pins.

Preferably, the ink-ribbon guide comprises two rotatable locking bodies which are rotatable in each case around axes disposed perpendicular to the print-head carriage. The two locking bodies, in each case, can be rotated into a first lifted position relative to the ink ribbon as an unlocked position relative to the print head, as well as into a second ink-ribbon change position as a position which is locked relative to the print head, and into a third ink-ribbon guide position as a position which is spatially fixed relative to the print head.

Preferably, the rotatable locking bodies are made of one-piece plastic parts. These locking bodies can form guide faces for the ink ribbon. The guide faces can be placed staggered opposite to each other. The locking bodies can each be furnished with a handle extending upwardly.

A detent stop can be provided at a flange forming part of the print head for each locking body. A spring-supported locking bolt can be provided at a flange forming part of the print head for each locking body.

Preferably, a locking trough disposed opposite to the springing locking bolt is provided on the flange of the print head for the locking positions.

A method of servicing a print mechanism of a matrix printer comprises that a carriage guide is disposed in parallel in front of a print-surface support. A print-head carriage is guided by a carriage guide. A print head is supported by the print-head carriage. An ink-ribbon guide is disposed on the print-head carriage. The print head is insertingly positioned on the print-head carriage via a mechanical guide and with an electric plug connection disposed at the print head carriage. At least one ink-ribbon guide is rotatably disposed on the print-head carriage as locking means for the insertingly positioned print head on the print-head carriage.

The print head on the print-head carriage can be released via the mechanical guide and with the electric plug connection disposed at the print head carriage.

The print head can be guided section-wise on two alignment pins. The mechanical guide can comprise the two parallel alignment pins in perpendicular position attached to the print-head carriage. Bores corresponding to the alignment pins can be coordinated in a flange of the print head. An electrical plug connection can be furnished by inserting the print head. The electric plug connection can comprise a plug contact strip.

Two rotatable locking bodies of the ink-ribbon guide in each case can tilt around axes disposed perpendicular to the print-head carriage.

The locking bodies can be actuated with a handle attached to the locking body extending upwardly. The rotatable locking bodies can be made of one-piece plastic parts. The locking bodies can form guide faces for the ink ribbon. Said guide faces can be placed staggered opposite to each other. The two locking bodies can be rotated into a first lifted position relative to the ink ribbon as an unlocked position relative to the print head. The two locking bodies can be rotated into a second ink-ribbon change position as a position which is locked relative to the print head. The two locking bodies can also be rotated into a third ink-ribbon guide position as a position which is spatially fixed relative to the print head.

A locking body can lock with a detent stop provided at a flange forming part of the print head and with a spring-supported locking bolt provided at a flange forming part of the print head. A locking trough disposed opposite to the springing locking bolt on the flange of the print head can engage for securing a locking position.

In accordance with the invention, the print head is removable from and again insertable into the print-head carriage via a mechanical guide and with an electric plug connection. At least one rotatable ink-ribbon guide, disposed on the print-head carriage, serves as a locking means for the inserted print head on the print-head carriage. This construction achieves two purposes. The mechanical guide creates simultaneously the precondition to allow an electric connection and to make possible an exhchange of the print head by operating personnel. It is further achieved that the ink-ribbon guide is employed for bolting of the print head. Thus, the ink-ribbon guide assumes a completely novel function.

Advantageously, the mechanical guide comprises two alignment pins disposed in parallel and inserted perpendicular into the print-head carriage. Bores corresponding to the alignment pins are coordinated in a flange of the print head, and the electric plug connections form a plug-contact strip, which start upon the insertion of the print head, if the print head is already guided in sections on the alignment pins. Such a construction allows that even operating personnel, not well familiar with technical matters, can achieve an electric connection of the print head without difficulties such that an exchanged print head is disposed in each case in a technically problem-free position.

According to a further feature of the invention, the ink-ribbon guide comprises two locking bodies rotatable in each case around axes standing perpendicular on the print-head carriage. It is in fact possible with two locking bodies, left and right of the front print-head part, to bring the ink ribbon in a position ahead of the print-element front edge and to set to the proper distance.

According to a further improvement provided by the invention, the two locking bodies can be tilted, in each case, into a position lifted-up with respect to the ink ribbon and unlocked with respect to the print head and, further, into an ink-ribbon change position and into a position which is locked with respect to the print head and, furthermore, into an ink-ribbon guide position and a position which fixes the print head. The first recited position allows the change position for the print head. The second recited position allows the change of the ink ribbon, and the third recited position is the operating position of the print head and of the ink ribbon.

According to additional features of the invention, the rotatable locking bodies are produced from one-piece plastic parts, which form the guide faces for the ink ribbon, which are disposed opposite to each other in a staggered position. In each case, an upwardly extending handle is provided on the ink-ribbon guide. This construction allows to operate the individual locking bodies without difficulties and, as clearly obvious, for providing these functions.

An additional improvement provided by the invention comprises that, in each case, a detent stop and a spring-supported locking bolt are provided at the flange of the print head for each locking body. These features assure a technically problem-free position of the print head in operating position.

It is further disclosed that, in each case, a locking trough, disposed opposite to the spring-supported locking bolt, is provided at the flange of the print-head for the locking positions. Such a construction allows locking and catching in the predetermined positions.

The novel features which are considered as characteristic for he invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1A:
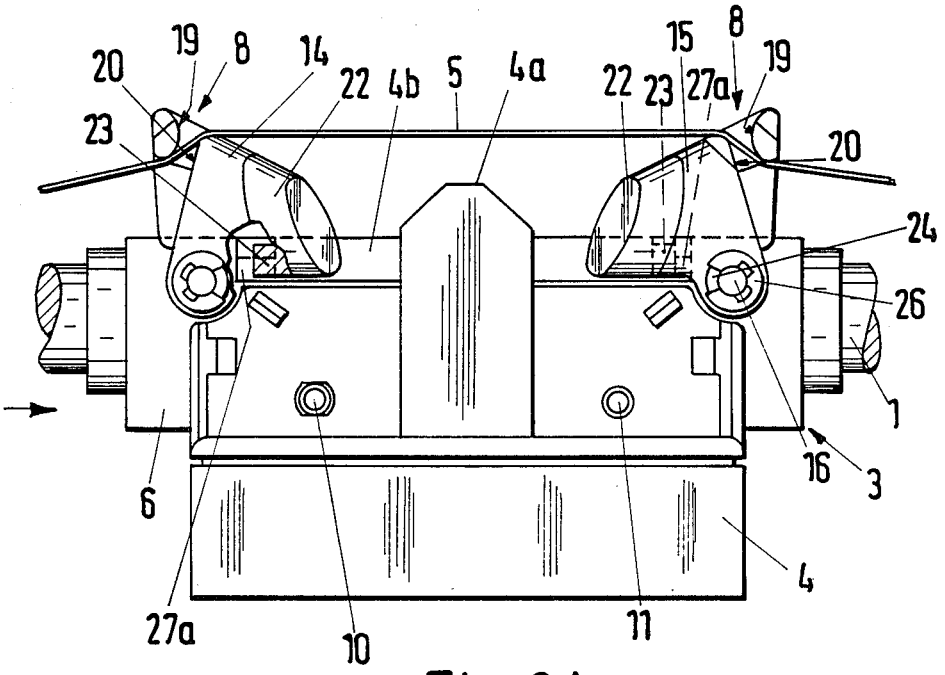
FIG. 1A is a plan view onto the print-head carriage with the print head of a matrix printer in the print-head exchange position (print head is unlocked)

A matrix printer with a carriage guide 6 runs in parallel in front of a print-surface support for a print-head carriage 3. The print-head carriage 3 supports a print head and an ink-ribbon guide is disposed on the print-head carriage. The print head 4 can be insertingly positioned and released on the print-head carriage 3 via a mechanical guide 6 and with an electric plug connection 7. At least one ink-ribbon guide 8 is rotatably disposed on the print-head carriage 3 as locking means 9 for the insertingly positioned print head 4 on the print-head carriage 3.

The mechanical guide 6 can comprise two parallel alignment pins 10, 11 attached perpendicular to the print-head carriage 3. Bores 12 corresponding to the alignment pins 10, 11 can be coordinated in a flange 4b of the print head 4. The electric plug connection 7 can comprise a plug contact strip 7*a*. The electric plug connection can start at the insertion of the print head 4, if the print head 4 is already guided section-wise on the alignment pins 10, 11.

Preferably, the ink-ribbon guide 8 comprises two rotatable locking bodies 14, 15 which are rotatable in each case around axes 16 disposed perpendicular to the print-head carriage 3. The two locking bodies 14, 15, in each case, can be rotated into a lifted position relative to the ink ribbon 5 as an unlocked position (FIG. 1A) relative to the print head 4 and, furthermore into an ink-ribbon change position as a position (FIG. 2A) which is locked relative to the print head 4, as well as into an ink-ribbon guide position as a position (FIG. 3A) which is fixed relative to the print head 4.

Preferably, the rotatable locking bodies 14, 15 are made of one-piece plastic parts, which form guide faces 19, 20 for the ink ribbon 5. These guide faces 19, 20 can be placed staggered opposite to each other. A handle 22 can be provided which is extending upwardly.

A detent stop 17 or, respectively, 18 and a spring-supported locking bolt 23 can be provided in each case at the flange 4*b* of the print head 4 for each locking body 14, 15.

Preferably, a locking trough 27, disposed opposite to the springing locking bolt 23, is provided on the flange 4*b* of the print head 4 for the locking positions.

Figure 5:
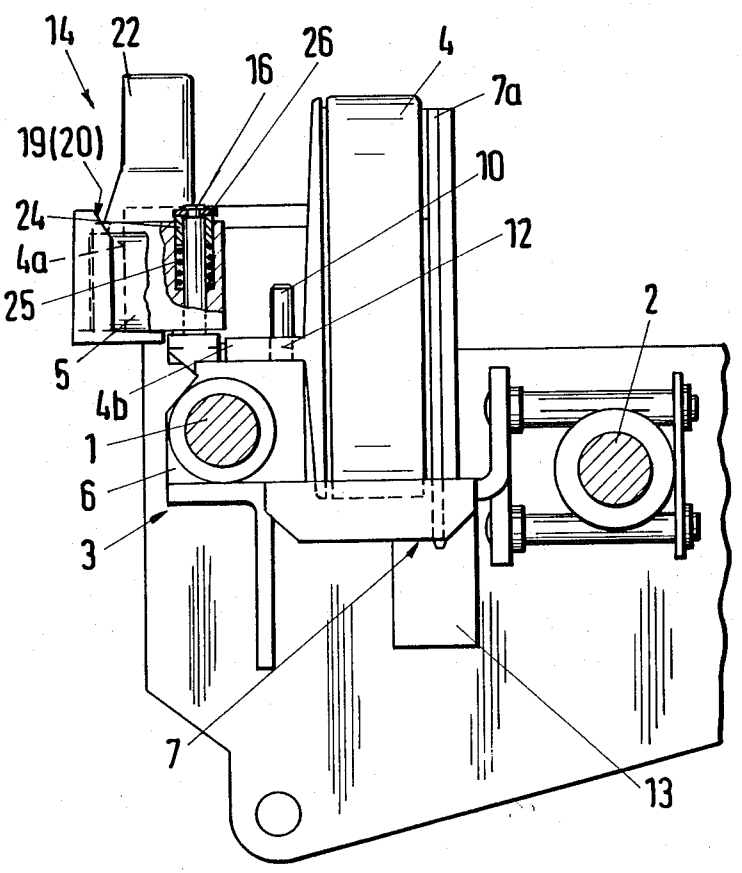
FIG. 5 is a side elevational view of the print-head carriage with the print head, as seen in the direction of motion of the print head.
Figure 7:
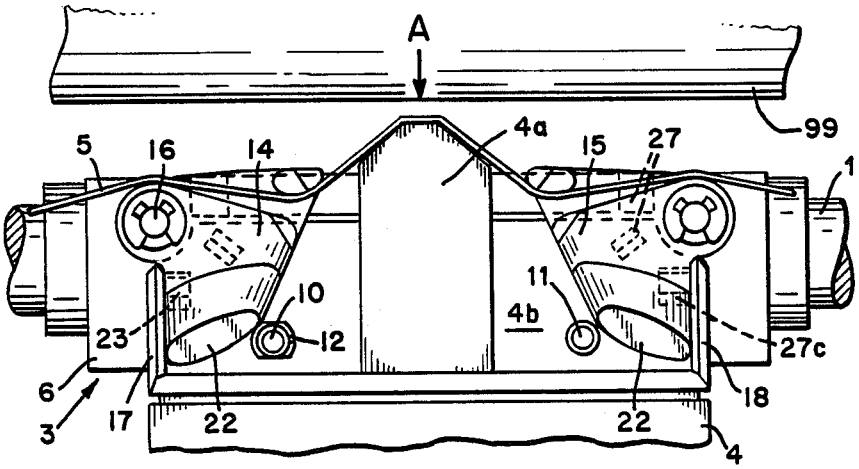
FIG. 7 is a plan view onto the printed head carriage with the print head in locked position, with the ink ribbon in operating position and with a print support surface visible.
Figure 8:
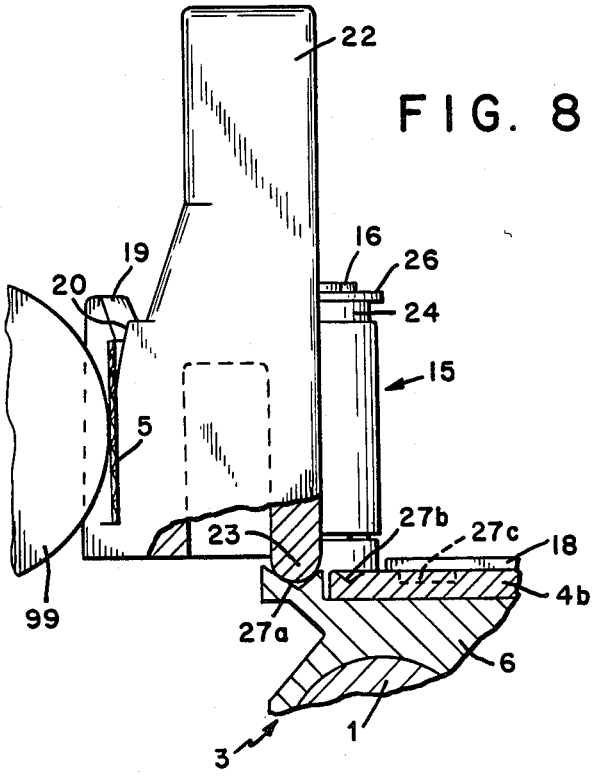
FIG. 8 is an in part sectional view of the locking body in the locking position together with a print-surface support.

A printer, in particular a matrix printer, includes a carriage guide, disposed ahead of a print-surface support (not shown), which is, for example, a platen. The carriage guide comprises a first carriage track axle 1, provided as guide rail, and a second carriage track axle 2, provided as guide rail, which run parallel (FIG. 5). The print-head carriage 3 with a print head 4 is moved back and forth on the carriage guide in order to write letters with a print head 4 on a print-support material resting on the print-surface support. For this purpose, an ink ribbon 5 is disposed between the print head 4 and the print-support material, not illustrated here. Print pins are disposed in one or several slots in the front part of the print-head part 4*a*. The print head 4 can also comprise a thermo print head or the like.

Such a print head 4 can be removed from the print-head carriage 3 and can be inserted again, based on the above cited reasoning, where the exchange of a print head 4 is performed by the operating personnel of the printer themselves.

The print head 4 is supported, according to FIG. 1A, only in a mechanical guide 6, where the electric connections for each print element, for example each print pin, are collected in an electric plug connection 7, as shown in FIG. 5. The plug connection 7 forms a plate-shaped plug-contact strip 7a insulating the electric feed lines with respect to each other.

An ink-ribbon guide 8 is rotatably formed such that it can be rotated over a flange 4*b* of the print head 4 and forms then a locking means 9 for the print head 4. The locking means 9 is disengaged in FIG. 1A such that the print head 4 can be pulled out of its mechanical guide 6 and out of the electric plug connection 7 and can be easily removed to be substituted by another print head of a different construction or for repairing of the print head.

The mechanical guide 6 comprises, in the most simple case, two parallel alignment pins 10 and 11 which are perpendicularly fixedly inserted into the print-head carriage 3. In each case, bores 12 in the flange 4b of the print head 4 are coordinated to the alignment pins 10 and 11. The alignment pins 10 and 11 are constructed such that the separation distance alignment pins 10, 11 and print-head bores 12 is smaller or even negative upon insertion as compared with the separation contact strip 7*a* - plug socket 13. Preferably, the length of the alignment pins 10, 11 is from about one to two times the width of the ribbon for which the printer is intended. Upon insertion of the print head 4 the alignment pins 10 and 11 initially guide and fix in position the print head 4 through the bores 12 and thus the plug-contact strip 7*a* slides precisely into the corresponding plug socket 13 in the print-head carriage 3.

The ink-ribbon guide 8 for the ink ribbon 5 is formed by two symmetrically and mirror-image-like disposed locking bodies 14 and 15. The locking bodies 14 and 15 are disposed rotatable around axes 16, where the axes 16 rise perpendicular from the print-head carriage 3. Thus, three positions of the locking bodies 14 and 15 are available to the operating personnel.

According to FIG. 1A, the locking bodies 14 and 15 are disposed outside of the flange 4*b* of the print head 4 such that an exchange position for the print head 4 is created. In this case, the ink ribbon 5 is lifted up far above the ink-ribbon guide 8 from the front print-head part 4*a*.

The ink-ribbon guide 8, according to FIG. 2A, is in fact again somewhat rotated such that the print head 4 is locked, however, the rotary path is selected such that the ink ribbon 5 is fully extended along a straight line. In this position, the ink ribbon 5 can be easily exchanged. During the change of the ink ribbon, the ink-ribbon guide 8 secures, via the flange 4*b*, the print head 4 against changes in position. The ink ribbon 5 is not deflected in this position of the ink-ribbon guide 8 such that the insertion of the ink ribbon 5 can be easily performed.

Figure 2A:
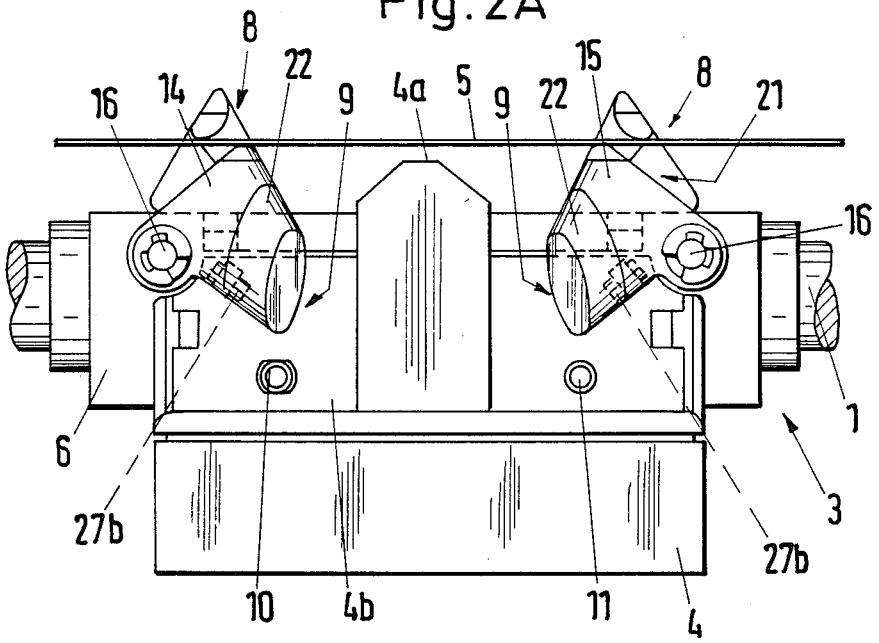
FIG. 2A is a plan view onto the print-head carriage with the print head in the ink-ribbon exchange position (print head is locked)

According to FIG. 2A, the ink-ribbon guide 8 is provided by the locking bodies 14 and 15 which are rotated, in each case, up to the detent stop 17 or, respectively 18. The ink ribbon 5 is guided under tension around the locking bodies 14 and 15 and around the front print-head part 4*a* in operating position. Thus, the print head 4 is also in a fixed position.

The described properties, operating positions, and effects of the guiding 8 of the ink-ribbon are determined by a suitable construction and forming of the locking bodies 14 and 15. These locking bodies 14 and 15 are produced from one-piece plastic parts and thus do not present any substantial load for the print-head carriage. In each case, rounded formed guide faces 19 and 20 are formed, which are disposed staggered and opposite to each other such that a wide channel 21 is generated. In each case, a handle 22 is disposed toward the print head 4 in order to facilitate for the operating personnel a rotation of the locking bodies 14 and 15. The channel 21 is also formed at an inclined angle in upward direction in order to simplify the threading and feeding of the ink ribbon 5. The three positions of the locking bodies 14 and 15 are secured by at least one locking bolt 23. This locking bolt 23, as illustrated in FIG. 5, is supported with the aid of a fixed bushing 24 in the locking bodies 14 and 15 and the locking bolt 23 is resiliently supported with a spring 25. The spring path is limited by an axial securing ring or clip 26. In each case, locking troughs 27 are disposed opposite to the locking bolt 23 in the two positions, as illustrated in FIGS. 1A and 2A.

Figure 3A:
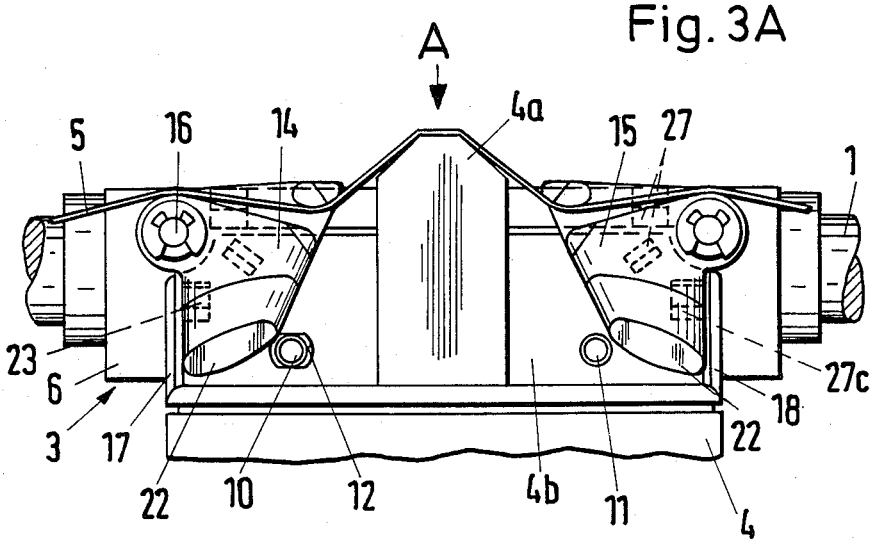
FIG. 3A is a plan view onto the print-head carriage with the print head in locked position and with the ink ribbon in operating position.
Figure 4:
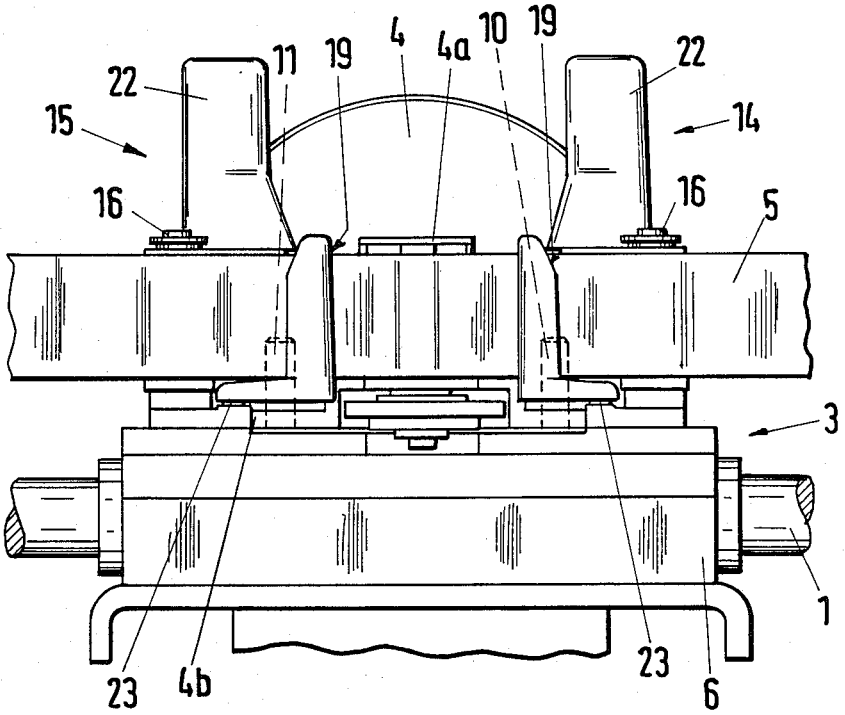
FIG. 4 is a front elevational view of the print-head carriage with the print head and the ink ribbon seen in the direction A of FIG. 3A.
Figure 6:
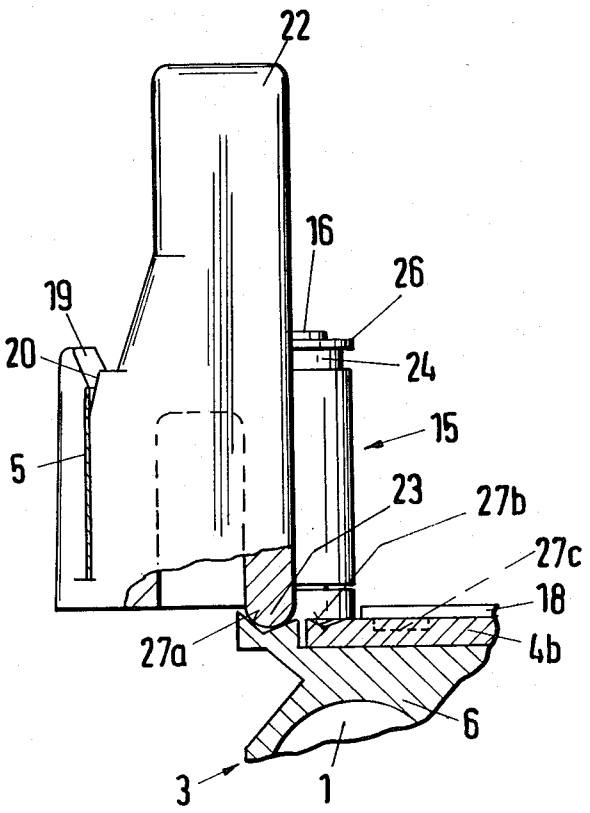
FIG. 6 is a view of a locking body in the locking position.

In each case, a locking trough 27*a* is provided for a locking position according to FIG. 1A, a locking trough 27*b* is provided for a locking position according to FIG. 2A, and a locking resting platform 27*c*, as illustrated in FIG. 6, is provided for the locking position according to FIG. 3A. This locking resting platform 27c effects a strong pretensioning of the spring 25 such that the print head 4 is solidly connected with the print-head carriage 3 in this position of the locking bodies 14 and 15 and rests against the detent stops 17 or, respectively, 18. Therefore, it is possible to perform printing in this position.

Preferably, the locking bodies 14 and 15 can rotate around an angle of about 90 degrees and the detent stops are contacted by the locking bodies in a direction which is in parallel to the guide rails 1 and 2. The position for inserting the straight-line ink ribbon should be at an angle which is within an angle corresponding to a center third angle between the angles marking the position for exchanging the print head, and the position of the locking bodies in operating position for running the printer. Preferably, the distance of the ink ribbon from the print head in a print-head removal position is at least twice that of the distance of the ribbon where the locking bodies are in ribbon-exchange position. Preferably, the axes of the locking bodies 14 and 15 are at a distance of from about 3 to 5 times the distance of the axis from the ink ribbon when the ink ribbon is on a straight line in the insertion position.

It will be understood that each of the elements described above, or two or more together, may also find a useful application in other types of printers differing from the types described above.

While the invention has been illustrated and described as embodied in the context of a printer, and in particular in the context of a a matrix printer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A matrix printer comprising a print surface support;

a carriage guide disposed in parallel in front of the print-surface support;

a print head;

a mechanical guide;

an electric plug connection;

an ink-ribbon guide;

a print-head carriage guided by the carriage guide and supporting the print head, and where the ink-ribbon guide is disposed on the print-head carriage, wherein the print head can be positioned by insertion and released on the print-head carriage via the mechanical guide and with an electric plug connection disposed at the print head carriage and where at least one ink-ribbon guide is rotatably disposed relative to an axis on the print-head carriage as locking means for the print head positioned by insertion on the print-head carriage;

wherein the ink-ribbon guide comprises two rotatable locking bodies which are rotatable in each case around axes disposed perpendicular to the print-head carriage direction of motion;

wherein the two locking bodies, in each case, can be rotated into a first lifted position of the locking bodies relative to the ink ribbon as an unlocked position relative to the print head, into a second ink-ribbon change position of the locking bodies as a position which is locked relative to the print head, and into a third ink-ribbon guide position of the locking bodies as a position which is spatially fixed relative to the print head.

2. The matrix printer according to claim 1, wherein the mechanical guide comprises two parallel alignment pins in perpendicular position attached to the print-head carriage, where bores corresponding to the alignment pins are coordinated in a flange of the print head and where the electric plug connection comprises a plug contact strip, which electric plug connection is furnished by an insertion of the print head, where the print head is already guided section-wise on the alignment pins.

3. The matrix printer according to claim 1, wherein the rotatable locking bodies are made of one-piece plastic parts, which locking bodies form guide faces for the ink ribbon, which guides faces are placed staggered opposite to each other and wherein the locking bodies each are furnished with a handle extending upwardly.

4. The matrix printer according to claim 1 further comprising a detent stop provided at a flange forming part of the print head for each locking body; and a spring-supported locking bolt provided at a flange forming part of the print head for each locking body.

5. The matrix printer according to claim 4 wherein a locking trough disposed opposite to the springing locking bolt is provided on the flange of the print head for the locking positions.

6. A matrix printer with a carriage guide running in parallel in front of a print-surface support for a print-head carriage, where the print-head carriage supports a print head, and with an ink-ribbon guide disposed on the print-head carriage, wherein the print head (4) can be positioned by insertion and released on the print-head carriage (3) via a mechanical guide (6) and with an electric plug connection (7) and where at least one ink-ribbon guide (8) is rotatably disposed relative to an axis on the print-head carriage (3) as locking means (9) for the print head (4) positioned by insertion on the print-head carriage (3); wherein the ink-ribbon guide (8) comprises two rotatable locking bodies (14, 15) which are rotatable in each case around axes (16) disposed perpendicular to the print-head carriage (3) direction of motion; wherein the two locking bodies (14, 15), in each case, can be rotated into a lifted position of the locking bodies relative to the ink ribbon (5) as an unlocked position (FIG. 1A) relative to the print head (4), furthermore into an ink-ribbon change position of the locking bodies as a position (FIG. 2A) which is locked relative to the print head (4), and furthermore into an ink-ribbon guide position of the locking bodies as a position (FIG. 3A) which is fixed relative to the print head (4).

7. The matrix printer according to claim 6, wherein the mechanical guide (6) comprises two parallel alignment pins (10, 11) attached perpendicular to the print-head carriage (3), where bores (12) corresponding to the alignment pins (10, 11) are coordinated in a flange (4*b*) of the print head (4) and where the electric plug connection (7) comprises a plug contact strip (7*a*), which electric plug connection starts at the insertion of the print head (4), if the print head (4) is already guided section-wise on the alignment pins (10, 11).

8. The matrix printer accoding to claim 6, wherein the rotatable locking bodies (14, 15) are made of one-piece plastic parts, which form guide faces (19, 20) for the ink ribbon (5), which guide faces (19, 20) are placed staggered opposite to each other and wherein a handle (22) is provided which is extending upwardly.

9. The matrix printer according to claim 6, wherein a detent stop (17 or, respectively, 18) and a spring-supported locking bolt (23) are provided in each case at the flange (4b) of the print head (4) for each locking body (14, 15).

10. The matrix printer according to claim 9, wherein a locking trough (27), disposed opposite to the springing locking bolt (23), is provided on the flange (4*b*) of the print head (4) for the locking positions.

11. A method of servicing a print mechanism of a matrix printer comprising disposing a carriage guide in parallel in front of a print-surface support;

guiding a print-head carriage by a carriage guide; supporting a print head by the print-head carriage;

disposing an ink-ribbon guide on the print-head carriage;

positioning the print head by insertion on the print-head carriage via a mechanical guide and with an electric plug connection disposed at the print head carriage; and rotatably disposing at least one ink-ribbon guide on the print-head carriage relative to an axis as locking means for the print head positioned by insertion on the print-head carriage;

rotating two rotatable locking bodies of the ink-ribbon guide in each case around axes disposed perpendicular to the print-head carriage direction of motion;

actuating the locking bodies with a handle attached to the locking body extending upwardly wherein the rotatable locking bodies are made of one-piece plastic parts, which locking bodies form guide faces for the ink ribbon, and which guide faces are placed staggered opposite to each other;

rotating the two locking bodies into a first position of the locking bodies relative to the ink ribbon as an unlocked position relative to the print head, rotating the two locking bodies into a second ink-ribbon change position of the locking bodies as a position which is locked relative to the print head, and rotating the two locking bodies into a third ink-ribbon guide position of the locking bodies as a position which is spatially fixed relative to the print head.

12. The method of servicing a print mechanism of a matrix printer according to claim 11 further comprising releasing the print head on the print-head carriage via the mechanical guide and with the electric plug connection disposed at the print head carriage.

13. The method of servicing a print mechanism of a matrix printer according to claim 11 further comprising guiding the guide head section-wise on two alignment pins, where the mechanical guide comprises the two parallel alignment pins in perpendicular position attached to the print-head carriage, where bores corresponding to the alignment pins are coordinated in a flange of the print head; and furnishing an electrical plug connection by inserting the print head, where the electric plug connection comprises a plug contact strip.

14. The method of servicing a print mechanism of a matrix printer according to claim 11 further comprising locking a locking body with a detent stop provided at a flange forming part of the print head and with a spring-supported locking bolt provided at a flange forming part of the print head; and engaging a locking trough disposed opposite to the springing locking bolt on the flange of the print head for securing a locking position.

15. The matrix printer according to claim 1, further comprising a detent stop provided at a flange forming part of the print head for each locking body; and a spring-supported locking bolt provided at a flange forming part of the print head for each locking body;

wherein a locking trough disposed opposite to the springing locking bolt is provided on the flange of the print head for the locking positions;

wherein the mechanical guide comprises two parallel alignment pins in perpendicular position attached to the print-head carriage, where bores corresponding to the alignment pins are coordinated in a flange of the print head and where the electric plug connection comprises a plug contact strip, which electric plug connection is furnished by an insertion of the print head, where the print head is already guided section-wise on the alignment pins;

wherein the rotatable locking bodies are made of one-piece plastic parts, which locking bodies form guide faces for the ink ribbon, which guide faces are placed staggered opposite to each other and wherein the locking bodies each are furnished with a handle extending upwardly.

16. The matrix printer according to claim 6, wherein the mechanical guide (6) comprises two parallel alignment pins (10, 11) attached perpendicular to the print-head carriage (3), where bores (12) corresponding to the alignment pins (10, 11) are coordinated in a flange (4b) of the print head (4) and where the electric plug connection (7) comprises a plug contact strip (7a), which electric plug connection starts at the insertion of the print head (4), if the print head (4) is already guided section-wise on the alignment pins (10, 11);

wherein the rotatable locking bodies (14, 15) are made of one-piece plastic parts, which form guide faces (19, 20) for the ink ribbon (5), which guide faces (19, 20) are placed staggered opposite to each other and wherein a handle (22) is provided which is extending upwardly; wherein a detent stop (17 or, respectively, 18) and a spring-supported locking bolt (23) are provided in each case at the flange **(4*b*) of the print head (4) for each locking body (14, 15); wherein a locking trough (27), disposed opposite to the springing locking bolt (23), is provided on the flange (4b) of the print head (4)** for the locking positions.

17. The method of servicing a print mechanism of a matrix printer according to claim 11 further comprising releasing the print head on the print-head carriage via the mechanical guide and with the electric plug connection disposed at the print head carriage;

guiding the print head section-wise on two alignment pins, where the mechanical guide comprises the two parallel alignment pins in perpendicular position attached to the print-head carriage, where bores corresponding to the alignment pins are coordinated in a flange of the print head; and furnishing an electrical plug connection by inserting the print head, where the electric plug connection comprises a plug contact strip;

locking a locking body with a detent stop provided at a flange forming part of the print head and with a spring-supported locking bolt provided at a flange forming part of the print head; and engaging a locking trough disposed opposite to the springing locking bolt on the flange of the print head for securing a locking position.

18. A matrix printer comprising a print surface support;

a carriage guide disposed in parallel in front of the print-surface support;

a carriage guide disposed in parallel in front of the print-surface support;

a print head;

a mechanical guide;

an electric plug connection;

an ink-ribbon guide including a locking body and a rounded formed guide face;

a print-head carriage guided by the carriage guide and supporting the print head, and where the ink-ribbon guide is disposed on the print-head carriage, wherein the print head can be positioned by insertion and released on the print-head carriage via the mechanical guide and with an electric plug connection disposed at the print head carriage and where at least one ink-ribbon guide is rotatably disposed relative to an axis on the print-head carriage as locking means for the insertingly positioned print head on the print-head carriage;

wherein the ink-ribbon guide comprises two rotatable locking bodies and two rounded formed guide faces which are rotatable in each case around axes disposed perpendicular to the print-head carriage direction of motion;

wherein the two locking bodies, in each case, can be rotated into a first lifted position of the locking bodies relative to the ink-ribbon as an unlocked position relative to the print head such that the ink-ribbon in front of the print head is tensioned in a relative remote position by the locking bodies and contacts the rounded formed guide faces substantially in a plane disposed between the spanned ribbon and the print head and at a point, which is relative remote relative to the front of the print head as compared with the contact with the respective locking body;

into a second ink-ribbon change position of the locking bodies as a position which is locked relative to the print head, wherein the ribbon passes substantially as a straight line between the locking bodies and the rounded formed guide faces; and into a third ink-ribbon guide position of the locking bodies as a position which is spatially fixed relative to the print head and such that the ink-ribbon in front of the print head is tensioned in a close position relative to the print head by the rounded formed guide faces disposed to the rear of the front of the print head and where the ink-ribbon contacts the locking bodies substantially in a plane intersecting the spanned ribbon twice between the rounded formed guide faces and the print head and where the ink-ribbon contacts the locking bodies at a second section distant relative to the print head as compared with the rounded formed guide faces.

19. The matrix printer according to claim 18, wherein the ink ribbon comprises two rotatable locking bodies which are rotatable in each case around an axis disposed perpendicular to the print head carriage direction of motion and perpendicular to the print head pin direction of print action motion.

20. A matrix printer with a carriage guide running in parallel in front of a print-surface support for a print head carriage, where the print-head carriage supports a print head, and with an ink-ribbon guide including a locking body and a rounded formed guide face and disposed on the print head carriage, wherein the print head (4) can be positioned by insertion and released on the print head carriage (3) via a mechanical guide (6) and with an electric plug connection (7) and where at least one ink-ribbon guide (8) is rotatably disposed relative to an axis on the print-head carriage (3) as locking means (9) for the insertingly positioned print head (4) on the print-head carriage (3);

wherein the ink-ribbon guide comprises two rotatable locking bodies which are rotatable in each case around axes disposed perpendicular to the print-head carriage direction of motion;

wherein the two locking bodies, in each case, can be rotated into a first lifted position of the locking bodies relative to the ink ribbon as an unlocked position relative to the print head, into a second ink-ribbon change position of the locking bodies as a position which is locked relative to the print head, and into a third ink-ribbon guide position of the locking bodies as a position which is spatially fixed relative to the print head.

21. A method of servicing a print mechanism of a matrix printer comprising disposing a carriage guide in parallel in front of a print-surface support;

guiding a print head carriage by a carriage guide;

supporting a print head by the print-head carriage;

disposing an ink-ribbon guide including a locking body and a rounded formed guide face on the print-head carriage;

positioning the print head by insertion on the print-head carriage via a mechanical guide and with an electric plug connection disposed at the print head carriage; and rotatably disposing at least one ink-ribbon guide on the print-head carriage relative to an axis as locking means for the print head positioned by insertion on the print-head carriage;

rotating one of two rotatable locking bodies forming part of the ink ribbon guide into a first lifted position of the locking bodies relative to the ink ribbon as an unlocked position relative to the print head, which rotatable locking bodies are rotatable in each case around axes disposed perpendicular to the print-head carriage direction of motion;

rotating said rotatable locking body forming part of the ink ribbon guide into a second ink-ribbon change position of the locking bodies as a position which is locked relative to the print head; and rotating said rotatable locking body forming part of the ink ribbon guide into a third ink-ribbon guide position of the locking bodies as a position which is spatially fixed relative to the print head.

* * * * *